United States Patent [19]

Henderson

[11] 4,289,202

[45] Sep. 15, 1981

[54] WELL TUBING COUPLING APPARATUS

[75] Inventor: William D. Henderson, Frisco, Tex.

[73] Assignee: Otis Engineering Corporation, Dallas, Tex.

[21] Appl. No.: 67,746

[22] Filed: Aug. 20, 1979

[51] Int. Cl.[3] ..... E21B 43/00; F16L 35/00

[52] U.S. Cl. ..... 166/212; 166/125; 166/214; 285/DIG. 21; 285/DIG. 23; 285/18

[58] Field of Search ..... 166/125, 214, 212; 285/18, 318, 319, 33, 81, DIG. 21, DIG. 23

[56] References Cited

U.S. PATENT DOCUMENTS

| | | | |
|---|---|---|---|
| 3,005,493 | 10/1961 | Crowe et al. | 166/214 |
| 3,645,563 | 2/1972 | Rochelle | 285/DIG. 21 |
| 3,842,914 | 10/1974 | Mott | 285/DIG. 23 |
| 4,008,759 | 2/1977 | Blackwell | 166/125 |

*Primary Examiner*—James A. Leppink

*Attorney, Agent, or Firm*—H. Mathews Garland

[57] ABSTRACT

Well tubing coupling apparatus of the tubing seal divider type adapted for remote hydraulic release control to permit a tubing string including well tools above a packer to be removed for servicing from a lower tubing string extending through a packer while temporarily plugging the lower tubing string, such apparatus including a lower tubular housing section connectible on a lower tubing string and having a hydraulic lock and an upper housing section connectible on an upper tubing string adapted to mate with the lower housing section and having a latch operable with the hydraulic lock to releasably couple the housing sections together. Both annulus responsive and tubing responsive forms of the coupling apparatus are shown. An upper tubing string and the upper housing section is released from and reconnected with the lower tubing string and lower housing section by hydraulic pressure.

22 Claims, 9 Drawing Figures

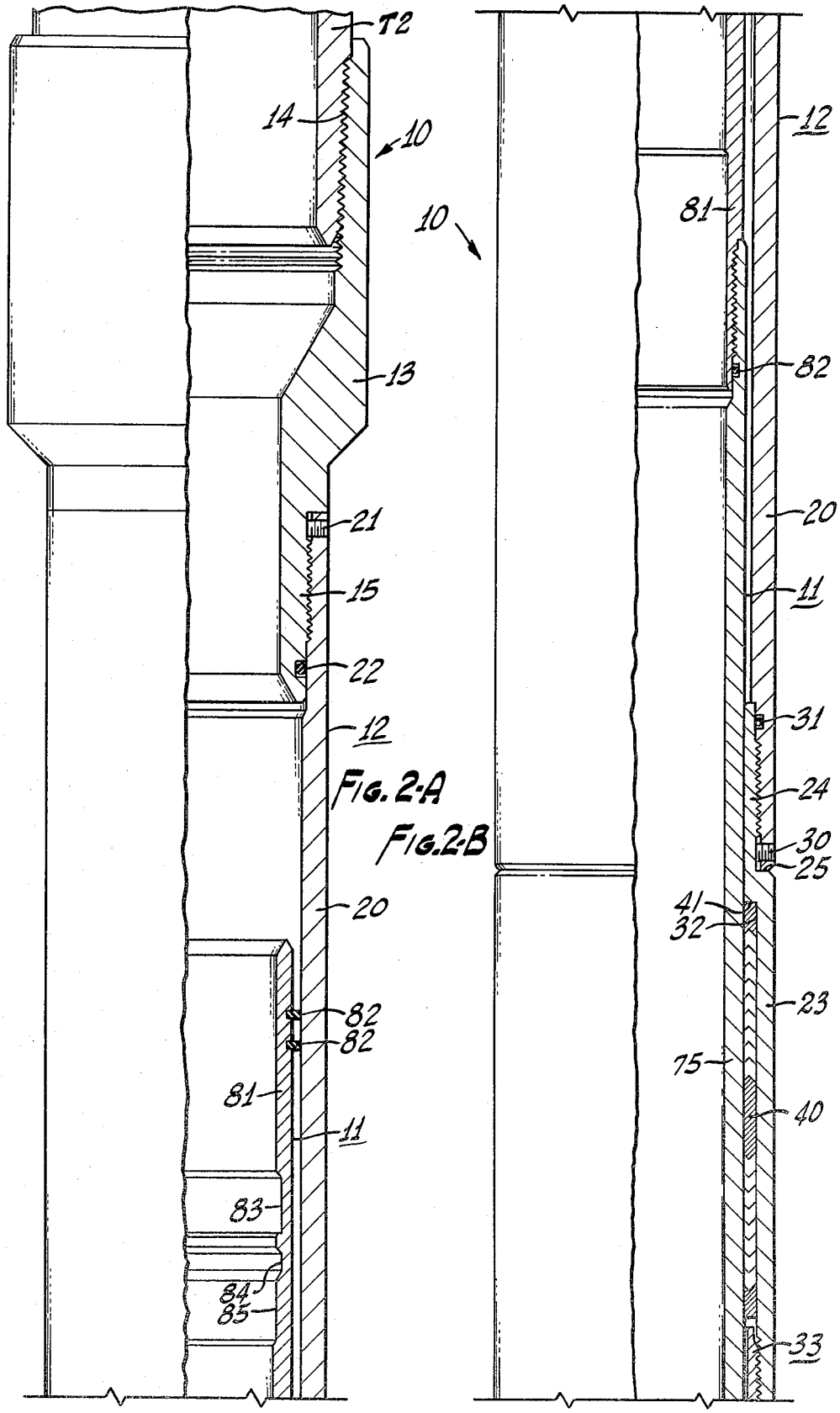
FIG. 2-A
FIG. 2-B

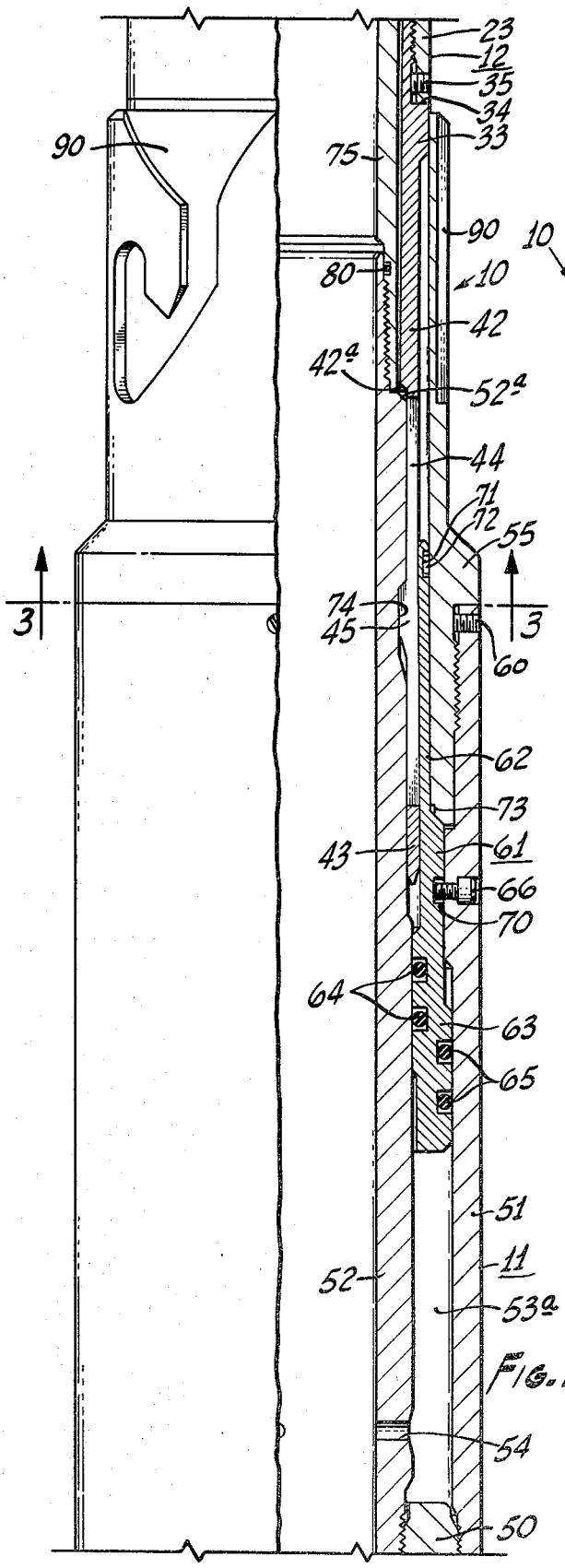
FIG. 2-C
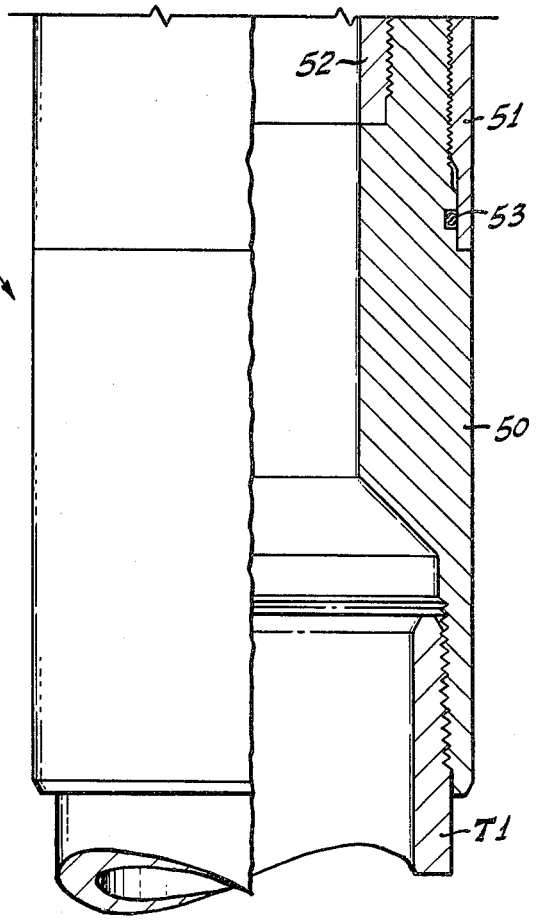
FIG. 2-D
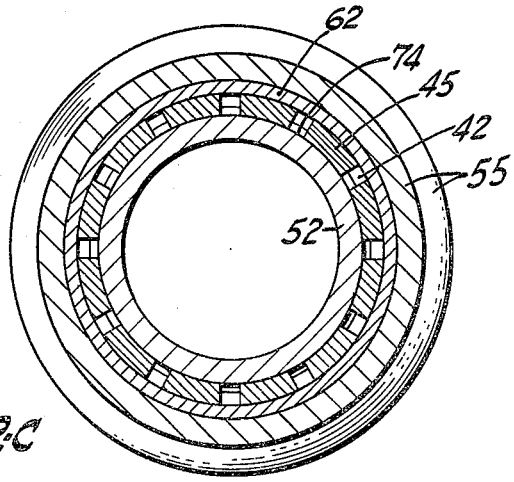
FIG. 3

WELL TUBING COUPLING APPARATUS

This invention relates to coupling apparatus for use with well tubing strings and more particularly relates to a hydraulic tubing seal divider for hydraulic release of an upper tubing string from a lower tubing string.

Oil and gas wells are generally fitted with well bore casing, liner and fluid production tubing strings for flowing petroleum oil and gas from an earth formation through the well bore to the surface. In such wells the tubing string or strings define flow paths through which well fluids may flow while the annulus space between the tubing string or strings and the well casing define an additional flow path which may serve to conduct well fluids to the surface or may simply contain static liquids for maintaining a hydrostatic head in the well bore for well known control purposes. Generally such wells also are equipped with packers which seal between the well casing and the tubing string or strings and the tubing string or strings include various flow control apparatus such as safety valves, gas lift valves and the like. Various conditions develop which make it desirable to remove the tubing string or strings above the packers for servicing the valves, correcting corrosion problems, and solve other problems which may develop and interfere with the operation of the wells. When tubing strings are removed for such purposes it is preferable that the upper portion of the tubing string above a packer be retrieved to the surface while plugging the tubing string at or above the packer temporarily while servicing the upper tubing string. To accomplish these steps it is known to provide in a tubing string a tubing seal divider which includes a male coupling member on the upper end of the lower tubing string above the packer and a female coupling member on the lower end of the upper tubing string. A locking recess is provided in one of the coupling members while a mating locking lug is in the other coupling member so that one of the coupling members is rotated relative to the other for connecting and disconnecting the upper and lower tubing strings. Annular seals are provided in one of the couplings for sealing with the other when the couplings are connected together. The male coupling on the lower tubing string includes a landing nipple in which a plug is landed and locked for closing off the lower tubing string while the upper tubing string is removed and serviced. Such a system is offered by Otis Engineering Corporation as illustrated and described at page 3939 of the 1974–75 Edition of The Composite Catalog of Oilfield Services and Equipment published by World Oil, Houston, Texas. The problem of removing an upper tubing string from a lower tubing string has also been solved by the use of a safety joint. The principal difficulty with the existing tubing seal dividers is that rotation of the entire upper tubing string is required for disconnecting and thereafter reconnecting the upper tubing string and the lower tubing string. Where safety joints are employed to connect the upper and lower tubing strings they normally must be destroyed for removal of the upper tubing string.

It is therefore a principal object of the invention to provide a new and improved apparatus for coupling upper and lower tubing strings in a well bore.

It is another object of the invention to provide a new and improved well tubing string coupling apparatus of the tubing seal divider type.

It is another object of the invention to provide a tubing seal divider which does not require that the upper tubing string be rotated for connecting and reconnecting the string.

It is another object of the invention to provide a tubing seal divider for well tubing strings which may be unlatched and relatched by remote hydraulic control.

It is another object of the invention to provide a hydraulic tubing seal divider which is casing pressure responsive.

It is another object of the invention to provide a hydraulic tubing seal divider which is tubing pressure responsive.

It is another object of the invention to provide tubing seal dividers having a releasable lock which is spring biased toward a locking position.

It is another object of the invention to provide a hydraulic tubing seal divider which includes a tubular lower housing section connectible with a lower tubing string and having an annular longitudinally movable lock and a tubular upper housing section connectible on an upper tubing string adapted to mate with the lower housing section and having an annular latch member operable with the annular lock of the lower housing section for releasably coupling the upper housing section in mating relation with the lower housing section.

It is another object of the invention to provide a tubing seal divider which includes external recess features adapted to receive an overshot for retrieving the lower housing section and apparatus connected thereto.

In accordance with the invention there is provided a hydraulic tubing seal divider which includes a first lower tubular housing section connectible on the upper end of a lower tubing string and having a longitudinally movable annular lock and a tubular upper housing section connectible on the lower end of an upper tubing string and having annular locking means engageable with the annular lock of the lower housing section when the upper and lower housing sections are in coupled mating relationship for holding the housing sections together and disengageable from the annular lock responsive to hydraulic pressure communicated into the lower housing section. In one form of the device the annular lock is operable responsive to annulus pressure. In another form of the device the annular lock is operable in response to tubing pressure. In still further forms of the invention both the annulus pressure responsive and the tubing pressure responsive forms of the lock are spring biased toward the locking positions. More specifically, the annular lock in each form of the device is a longitudinally movable locking member while the annular latch in each device is a locking collet having radially movable collet heads which are locked and released responsive to the longitudinal position of the locking member.

The foregoing objects and advantages of the invention will be better understood from the following detailed description of preferred embodiments of the invention taken in conjunction with the accompanying drawings wherein:

FIG. 1 is a fragmentary longitudinal view in section and elevation of a cased well bore equipped with a packer and lower and upper tubing strings connected together by a hydraulic tubing seal divider embodying the features of the invention;

FIGS. 2-A through 2-D inclusive form a longitudinal view in section and elevation of an annulus pressure responsive form of the device of the invention illustrating the upper and lower tubing strings locked together by the device;

FIG. 2-A shows the upper end of the device;

FIG. 2-B shows an upper intermediate portion of the device;

FIG. 2-C shows a lower intermediate section of the device including the annular lock on the lower housing section and the annular latch on the upper housing section;

FIG. 2-D shows the lower end portion of the device;

FIG. 3 is a view in section along the line 3—3 of FIG. 2-C;

Figure 5:
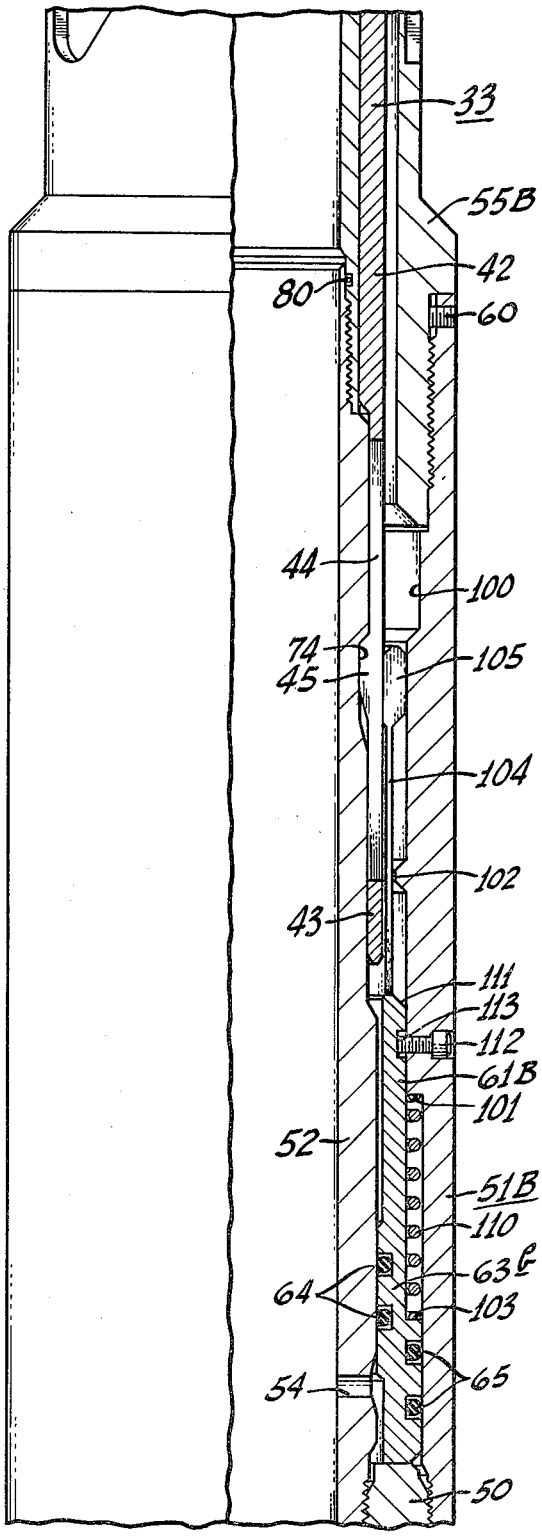
Figure 6:
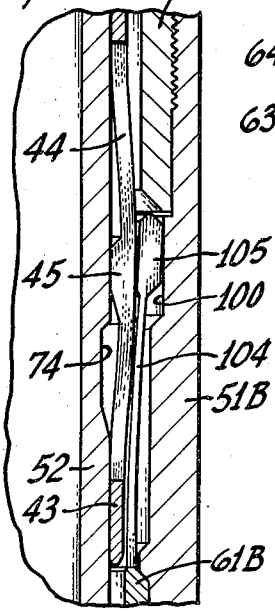

FIG. 5 is a longitudinal fragmentary view in section and elevation of a tubing pressure responsive form of the device including a spring for biasing the annular lock toward locked position showing the upper and lower housing sections locked together; and FIG. 6 is a fragmentary view in section and elevation showing the release positions of the annular lock and annular latch of the form of device shown in FIG. 5.

Figure 1:
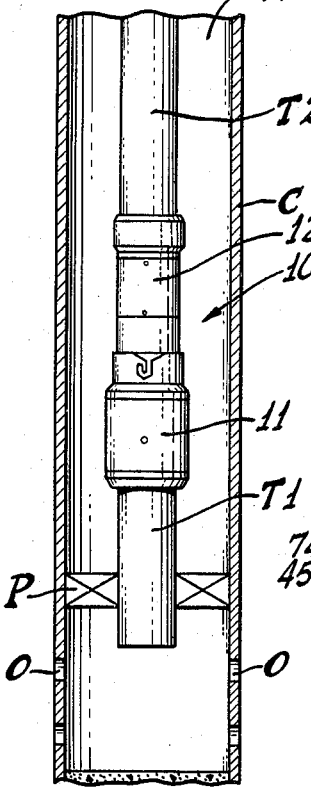

Referring to FIG. 1, a well W having a casing C provided with perforations O is fitted with a packer P sealing with the inner casing wall around a string of lower tubing T1 releasably connected with a string of upper tubing T2 by a hydraulic tubing seal divider 10 embodying the features of the invention. The tubing seal divider comprises a lower tubular housing section 11 connected on the upper end of the lower tubing string and an upper tubular housing section 12 connected on the lower end of the upper tubing string. The upper and lower housing sections of the tubing seal divider are releasably locked together and may be disconnected for retrieving the upper tubing string and upper housing section by application of hydraulic fluid pressure to the seal divider. Similarly the upper tubing string may be reconnected with the lower tubing string by reinserting the upper housing section into the lower housing section while applying sufficient hydraulic pressure to operate the locking system between the two housing sections. As discussed in detail hereinafter, the lower tubing string may be plugged temporarily by landing and locking a plug assembly in the lower housing section and the lower tubing string, packer, and lower housing section may be pulled from the well bore by use of standard available tools if necessary.

As illustrated in detail in FIGS. 2-A through 2-D, the upper and lower housing sections 12 and 11, respectively, of the tubing seal divider 10 telescope together in a mating relationship. The upper housing section includes a top sub 13 internally threaded along an enlarged upper end portion 14 which is threaded on the lower end of the upper tubing string T2 and externally threaded along a lower end portion 15 which is threaded into the upper end of a tubular body mandrel 20. Set screws 21 through the upper end portion of the body mandrel 20 engage the threaded portion 15 of the top sub locking the body mandrel and top sub together. A ring seal 22 within an external annular recess along the lower end portion of the top sub seals between the top sub and the body mandrel. Refering to FIG. 2-B the lower end of the body mandrel 20 threads on the upper end of a tubular connector 23 which has a reduced externally threaded upper end portion 24 above an external annular stop shoulder 25 which limits the extent to which the body 20 may thread on the connector 23. Set screws 30 through the lower end portion of the body 20 against the reduced upper end portion 24 of the connector lock the body 20 and connector together. A ring seal 31 in an internal annular recess of the body 20 above the lower internal threaded end portion of the body seals between the body 20 and the upper end portion of the connector 23. Below the stop shoulder 25 the connector 23 is enlarged in diameter defining an enlarged bore portion 32. The lower end portion of the connector 23 is threaded on an upper end portion of a tubular locking collet 33 against an upwardly facing external annular stop shoulder 34 on the locking collet. Set screws 35 threaded through the lower end portion of the connector 23 against the upper end portion of the locking collet 33 aid in holding the connector and locking collet together. An annular seal assembly 40 is confined within the enlarged bore portion 32 of the connector 23 held between the upper end of the collet 33 and an internal stop shoulder 41 at the upper end of the bore 32. The locking collet 33 has a tubular upper portion 42 connected with a lower end ring 43 by a plurality of longitudinal circumferentially spaced collet fingers 44 each of which is provided with a radially inwardly extending locking boss 45. The collet fingers 44 extending between the upper tubular portion 42 and the lower ring portion 43 of the locking collet are sufficiently flexible to expand radially outwardly from the locking position shown in FIG. 2-C to a release position, not shown, permitting upward retraction of the upper housing section 12 from the lower housing section 11.

Referring to FIGS. 2-C and 2-D, the lower housing section 11 includes a bottom sub 50 threaded along an enlarged lower end portion on the upper end portion of the lower tubing string T1. The upper end portion of the bottom sub 50 is internally and externally threaded to the lower ends of an outer housing sleeve 51 and an inner lower tubular latch mandrel 52. A ring seal 53 in an external annular recess around the bottom sub 50 seals between the bottom sub and the lower end portion of the housing sleeve 51. The housing sleeve 51 and the mandrel 52 are concentrically positioned in spaced relation defining between the housing sleeve mandrel an annular hydraulic cylinder chamber 53*a* which communicates with the bore through the mandrel 52 by circumferentially spaced ports 54 for applying hydraulic pressure into the chamber 53*a* from the bore of the mandrel. The upper end portion of the housing sleeve 51 threads on the lower end portion of a housing head 55 held by set screws 60 threaded through the sleeve against the housing head. The upper end portion of the housing sleeve 51 and the housing head 55 are spaced concentrically around the mandrel 52 defining an annular space in which a longitudinally slidable annular lock 61 is disposed. The lock 61 comprises a locking sleeve 62 on an annular piston 63 in the annular hydraulic chamber 53*a*. Pairs of internal ring seals 64 within internal annular recesses and external ring seals 65 within external annular recesses of the piston 63 seal between the piston and the outer surface of the mandrel 52 and the inner surface of the housing sleeve 51, respectively. Shear screws 66 extending through the housing sleeve 51 into recesses 70 around the outer surface of the piston 63 releasably lock the piston holding the annular lock 61 at the upper locking position illustrated in FIG. 2-C. The lock sleeve 62 of the annular lock 61 telescopes over the collet fingers 44 in an overlapping relationship when the annular lock is at the upper locking position of FIG. 2-C to hold the collet fingers 44 and the bosses 45 at inward locking positions preventing the upward withdrawal of the locking collet 33. The upper outer end portion of the lock sleeve 62 is provided with an external annular recess 71 for an outwardly biased split snap ring 72 which is placed in the lock sleeve when one time operation is desired, that is, the annular lock 61 is to be moved downwardly to the release position and not returned upwardly by remote hydraulic control. The snap ring 72 engages an internal annular locking notch 73 within the lower end portion of the housing head 55 so that when the annular lock 61 moves to a lower end release position the snap ring expands into the notch locking the annular lock at the release position.

The lower inner body locking mandrel 52 has an external annular locking recess 74 which is engageable by the locking bosses 45 on the collet fingers 44. When the collet fingers 44 are prevented from springing outwardly as when the fingers are held straight by the surrounding lock sleeve 62, the locking collets 45 are in the locking recess 74 so that the locking collet 33 on the lower end of the upper body section 12 of the tubing seal divider cannot be lifted upwardly and thus cannot be uncoupled from the bottom body section 11. The upper end of the body mandrel 52 threads into an intermediate or central body mandrel 75. A ring seal 80 carried in an internal annular recess along the lower end portion of the mandrel 75 seals between the mandrel 75 and the upper end portion of the mandrel 52. As shown in FIG. 2-B the upper end of the inner mandrel 75 threads on the lower end of an upper inner mandrel 81. A ring seal 82 in an internal annular recess along the upper end portion of the mandrel 75 seals between the mandrel 75 and the lower end portion of the mandrel 81. The mandrel 75 fits in close sliding relationship through the connector 23 of the upper housing section 12 along the upper end portion 24 of the connector above the stop shoulder 41. The seal 40 carried by the connector 23 seals between the connector and the outer surface of the mandrel 75. As shown in FIGS. 2-A and 2-B the upper end portion of the mandrel 75 and the mandrel 81 fit in spaced concentric relationship within the housing section 20 of the upper housing section 12. A pair of external rings 82 carried by the upper outer end portion of the mandrel 81 prevent trash from falling between the mandrel 81 and the housing section 20. The upper internal end portion of the upper mandrel 81 is provided with a landing nipple profile defined by the longitudinally spaced recesses 83, 84 and 85 which provide a landing nipple configuration adapted to receive such well tools as a plug choke as illustrated at page 3939 of the 1974–75 edition of The Composite Catalog of Oilfield Equipment and Services. The presence of the landing nipple profile within the upper end of the lower housing section 11 of the tubing seal divider permits insertion of a tubing plug through the upper tubing string T2 prior to uncoupling the upper housing section 12 from the lower housing section 11 so that when pulling the upper tubing section from a well the lower tubing section is left plugged.

Referring to FIG. 2-C, the upper end portion of the housing head 55 on the lower housing section 11 is provided with external J-slots 90. The J-slots 90 permit the lower housing section 11 to be engaged by an overshot having internal lugs which enter the slots 90 for connecting the lower housing section with the overshot to pull the lower tubing string T1 and the packer P by means of a handling string connected with the overshot.

When a well is completed as illustrated in FIG. 1 utilizing the hydraulic tubing sealing divider 10 of the invention, the lower tubing string T1 and the upper tubing string T2 connected together by the hydraulic tubing seal divider 10 are run into the well as a unit with the packer 11 which may be any suitable standard packer set by well known procedures. The lower housing section 11 and the upper housing section 12 of the tubing seal divider are telescoped together in the mating relationship illustrated in FIGS. 2-A through 2-D. The housing sections 20 and 23 with the locking collet 42 are telescoped downwardly on the inner mandrel sections 52, 75, and 81 of the lower housing section 11. The collet fingers 44 on the locking collet 42 are aligned along the inner mandrel 52 with the bosses 45 in the mandrel locking recess 74. When inserting the collet fingers 44 into the space between the mandrel 52 and the head member 55 of the lower housing section, the collet fingers spring outwardly until the bosses 45 are aligned with the recess 74. An internal annular stop shoulder **42*a* within the locking collet 42 is engageable with an external annular stop shoulder 52*a* around the upper end portion of the mandrel 52, FIG. 2-C, limiting how far downwardly the locking collet 42 will telescope over the inner mandrel 52. The annular lock 61, the housing sleeve 51, and the housing 55 of the lower body section 11 are assembled in the relationship shown in FIG. 2-C with the lock sleeve 62 telescoped over the collet fingers 44 and the shear pins 65 engaged through the housing sleeve 51 into the recess 70 locking the annular lock at the upper position for holding the collet fingers 44 inwardly. If during the operation of the tubing seal divider it is contemplated that a one time remote operation of the divider will be carried out, the snap ring 72 is placed in the recess 71 of the lock sleeve 62 during assembly of the device. If it is anticipated that repeated locking and unlocking of the collet may be necessary such as running and pulling the upper tubing string several times, the snap ring is not placed in the recess 71**. It is to be understood that with the snap ring in place one time operation of the annular lock will lock the piston in a lower end position from which it cannot be released remotely by hydraulic pressure.

After the hydraulic tubing seal divider 10 is assembled in the locked condition of FIGS. 2-A through 2-D it is connected with the upper and lower tubing strings T2 and T1 by means of the top and bottom subs 13 and 50 respectively. The tubing strings and seal divider are run into the well and the packer is set. Various well tools such as safety valves and gas lift valves may be included in the upper tubing string as required by the particular well. Thereafter when it is necessary to service the well tools in the upper tubing string or to correct corrosion problems along the tubing string, and the like, the hydraulic tubing seal divider functions to disengage the upper tubing string from the lower tubing string. To uncouple the upper body section 12 of the tubing seal divider from the lower body section 11, hydraulic pressure is applied in the well through the annulus between the casing C and the upper tubing string and seal divider above the packer. The hydraulic pressure is communicated from the annulus downwardly along the space within the tubular head member 55 around the locking collet 42 to the piston 63 of the annular lock 62. The hydraulic pressure acts over the area of the piston defined between the line of sealing of the ring seals 64 with the outer surface of the inner mandrel 52 and the line of sealing of the outer ring seals 65 with the inner wall of the body sleeve 51. When the downward force on the piston exceeds the holding strength of the shear pins 66, the pins shear allowing the hydraulic pressure to force the piston 63 downwardly until the lower end of the piston engages the upper end of the bottom sub 50. The downward movement of the piston 63 moves the lock sleeve 62 which is an integral member with the piston below the collet fingers 44 and the ring 43 at the lower end of the collet fingers. With the lock ring 62 moved downwardly to the lower end position the collet fingers are free to spring outwardly in the space between the housing head 55 and the outer surface of the inner mandrel 52. The upper housing section 12 is then free to be lifted upwardly from the lower housing section 11. An upward force applied to the upper tubing string lifts the upper housing 12 upwardly raising the top sub 13, the housing 20, the connector 23, and the annular collet lock member 33 down through and including the bottom ring portion 43 of the collet lock. The upward force on the collet fingers 44 causes the internal bosses 45 on the collet fingers to be cammed outwardly out of the locking recess 74 on the inner mandrel 52 of the lower housing section 11. As soon as the bosses 45 are cammed fully out of the locking recess 74 the upper housing section 12 is withdrawn from the lower housing section 11. With the upper housing section fully removed from the lower housing section the inner mandrel of the lower housing section 11 including the mandrel sections 81, 75, and 52 along with the outer upper housing section 55 of the lower body section 11 will remain in the well bore on the upper end of the lower tubing string T1.

If the conditions in the well preliminary to pulling the upper tubing string require that the lower tubing string be plugged, suitable standard procedures such as used in wireline operations are employed to install a plug in the landing nipple recesses 83, 84, and 85 within the upper end of the lower body section mandrel 81. This will leave the lower tubing string plugged while the upper tubing string is removed from the well and serviced. The annular locking collet 33 remains at the lower end release position.

After removal of the upper tubing string if it is necessary to remove the lower tubing string and the packer, a suitable overshot on a handling string as previously referred to at page 3939 of the 1974–75 edition of The Composite Catalog of Oilfield Equipment and Services may be run into the well with the internal lugs of the overshot engaging the J-shots 90 on the housing head 55 of the lower body section 11 for grasping the lower body section along with the lower tubing string T1 and the packer P for pulling them as a unit from the well bore.

After servicing the upper tubing string T2 it may be run back into the well and reconnected with the lower tubing string. The upper tubing string with the upper body section 12 of the tubing seal divider secured on the lower end of the tubing string is lowered in the well bore until the locking collet 33 telescopes downwardly over the inner mandrel of the lower body section 11. Since the annular lock 61 was left at the lower release position when the upper tubing string was pulled, the lock sleeve 62 is at a lower end position allowing the lower end ring 43 and collet fingers 44 to pass downwardly between the housing 55 and the inner mandrel 52 of the lower body section 11. The collet finger bosses 45 slide along the mandrel 52 springing inwardly into the lock recess 74 in the mandrel relatching the upper body section 12 with the lower body section 11. The plug installed in the landing nipple at the upper end of the mandrel 81 of the lower body section is removed and hydraulic pressure is applied through the tubing string to the ports 54 in the mandrel 52. The hydraulic fluid forces the piston 63 back upwardly moving the lock sleeve 62 between the collet fingers 44 and the housing head 55 above the locking bosses 45 on the collet fingers so that the collet fingers are again locked in position locking the upper body section 12 with the lower body section 11 of the tubing seal divider. As previously discussed, the upper body section may be relocked with the lower body section only if the snap ring 72 is omitted from the assembly. If the snap ring 72 is employed in the assembly such as when it is not desired to remotely relock the upper and lower body sections, when the annular lock 62 is forced downwardly by the hydraulic pressure in the annulus, the snap ring 72 moves outwardly as the ring moves below the internal notch 73 in the lower end of the housing head 55 so that the snap ring engages the notch 73 holding the annular lock 61 at the lower end release position. The annular lock cannot be hydraulically returned upwardly to relock the device with the snap ring 72 engaging the locking notch 73.

Figure 4:
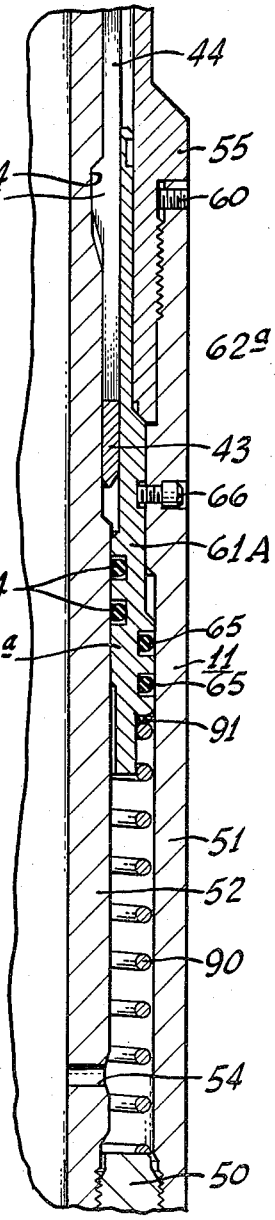
FIG. 4 is a fragmentary view in section of a portion of the locking system between the housing sections of the device illustrating particularly the form of the lock shown in FIG. 2-C in locked position with a spring for biasing the lock toward such position.

It will be recognized that the form of the device of the invention illustrated in FIG. 2-C requires a tubing pressure applied through the ports 54 into the annular chamber 53 exceeding the annulus pressure communicated to the piston 63 of the annular lock 61 when the upper tubing string has been once removed and the device relocked. Under such conditions the shear pins 66 will no longer be intact and thus an annulus pressure which exceeds the tubing pressure would force the annular piston 63 back downwardly returning the lock sleeve 62 to the lower release position. Under such operating conditions a modified form of the invention as illustrated in FIG. 4 must be employed. The form of the device represented in FIG. 4 is identical to that of FIGS. 2-A–2-D except that the form shown in FIG. 4 includes a modified annular lock 61A and a spring 90 for biasing the annular lock upwardly to the locking position. Referring to FIG. 4 the annular lock 61A has a locking sleeve 62*a* and an annular piston 63*a* which has a reduced lower external diameter defining a downwardly facing annular stop shoulder 91 on the piston. The spring 90 is a coil spring confined at opposite ends between the piston shoulder 91 at the upper end and the upper end of the bottom sub 50 at the lower end of the spring. The piston has the same arrangement of inner and outer ring seals 64 and 65 as described with regard to FIG. 2-C. The annular lock 61A is initially secured in position by the shear screws 66 holding it at the lock position which prevents uncoupling of the upper body section 12 of the tubing seal divider. The modified tubing seal divider of FIG. 4 is released in response to hydraulic pressure in the annulus in exactly the same manner as the form shown in FIG. 2-C. When the upper body section is removed from the lower body section the spring 90 returns the annular lock 61A back upwardly to the locked position. For recoupling the upper tubing spring and upper body section 12 with the lower body section in the form of FIG. 4 the annular lock 61A may be hydraulically forced back downwardly by annulus pressure to the release position for reinserting the collet lock. After the collet lock is back in locking position as shown in FIG. 4 the annulus pressure is reduced and the spring returns the annular lock 61A back upwardly to the locked position at which the lock sleeve 62*a* prevents the collet fingers 44 from releasing from the locking recess 74. The annular lock will remain at the upper locked position even though inadequate tubing pressure is within the bore of the mandrel 52 because the spring 90 holds the annular lock up. p Under well conditions which render it necessary to release the connection between the upper and lower body sections of the tubing seal divider responsive to tubing pressure conducted to a divider through the upper tubing string T2 and the casing pressure is thereafter inadequate to hold the annular lock at a locked position, a further modified form of the device of the invention as illustrated in FIG. 5 may be used. Referring to FIG. 5 a modified form of housing section 51B is threaded on the lower end of the housing head section 55B. An internal annular release recess 100 is provided in the housing of the lower body section in the modified form of FIG. 5. The bore through the housing section 51B is enlarged along the lower end section providing a downward facing internal annular stop shoulder 101. An internal annular stop flange 102 is provided within the housing section 51B. A modified form of annular lock 61B includes a piston portion 63*b* having an external annular upwardly facing stop shoulder 103. The annular lock 61B also has upwardly extending circumferentially spaced collet fingers 104 each of which has a locking head 105 which holds the collet fingers 44 on the lower end portion of the upper body section 12 in locked position when the annular lock 61B is at the lower end locked position of FIG. 5. A spring 110 around the annular piston 63*b* is confined between the housing stop shoulder 101 and the piston stop shoulder 103 biasing the piston downwardly to the lower end position at which the collet heads 105 hold the collet fingers 44 inwardly so that the collet finger bosses 45 are captured in the locking recess 74 of the inner mandrel 52 on the lower body section. The annular lock 61B has an upwardly facing external annular stop shoulder 111 which is engageable with the stop flange 102 limiting the upward movement of the annular lock to prevent the upper ends of the collet finger heads 105 from striking the upper end of the release recess 100 when the annular lock is moved upwardly to release position. Shear pins 112 through the housing 51B engage an external annular recess 113 in the annular lock 61B initially holding the lock at the lower locked position.

The modified form of the tubing seal divider shown in FIG. 5 is operated to release the upper body section from the lower body section to pull the upper tubing string by applying sufficient hydraulic pressure through the tubing string to the ports 54 which forces the piston 63*b* upwardly raising the annular lock 61B until the lock is at an upper end position at which the shoulder 111 engages the stop flange 102 in the housing aligning the collet heads 105 with the release recess 100 as shown in FIG. 6. After the increase of the tubing pressure sufficiently to shift the lock system to the release condition, a suitable tubing plug as previously discussed is landed and locked in the landing nipple recesses 83, 84 and 85 of the upper end portion of the inner mandrel 81 on the lower body section 11. Plugging the lower tubing string holds the pressure within the tubing string and maintains the piston 63*b* with the locking collet heads 105 at the upper release position while an upward force is applied to the upper tubing string T2 pulling the tubing string with the upper body section 12 upwardly withdrawing the collet 45 from the locked condition within the lower body section thereby uncoupling the upper body section from the lower body section so that the upper tubing string is fully released and may be pulled from the well. The tubing pressure being held within the closed lower tubing string holds the annular lock 61B at the upper release position. Thereafter the upper tubing string with the upper body section 12 may be run back into the well and recoupled with the lower tubing string since the annular lock of the lower body section is in the release position. It will be recognized that after reconnecting the upper tubing string with the lower tubing string the shear pins 12 will no longer hold the annular lock in the lower locked position. With inadequate casing pressure to hold the lock downwardly the spring 110 is designed to overcome the tubing pressure as applied through the ports 54 for holding the annular lock down as shown in FIG. 5.

It will be recognized that the several embodiments of the invention disclosed and illustrated permit the invention to be used under various well conditions. The several embodiments described and illustrated differ only in the details of the structure and operating characteristics of the locking systems employed between the upper and lower body sections. The form shown in FIG. 2-C is released in response to casing pressure and thereafter is held in a locked condition after the shear pins have been severed by the tubing pressure exceeding the casing pressure. The form of the lock system illustrated in FIG. 4 is also released in response to casing pressure but employs a spring to maintain a locked condition if inadequate tubing pressure exists to hold the piston 63*a* at the upper end position. The form of the lock system illustrated in FIG. 5 is tubing pressure released and after severing the shear pins employs the spring 110 to maintain the locked condition in the absence of sufficient pressure in excess of the tubing pressure. If tubing pressure release is desired but there will be sufficient casing pressure thereafter to hold the lock system in a locked condition, the spring 110 may be omitted.

It will be further recognized that the particular operating characteristics of each of the forms of the lock system disclosed for the tubing seal divider of the invention may be varied by changes in the material and size of the shear pins and the effective cross sectional areas of the lock system operating pistons exposed to the casing annulus and the tubing pressures. While each of the forms of the invention respond to different pressure conditions between the casing and annulus and different pressure values, all forms of the invention are remotely hydraulically operable for uncoupling and recoupling a removable upper tubing string and a lower tubing string which remains in a well bore. Also in the event of an emergency each form of the invention permits mechanical connection with the lower body section and tubing string with the packer for removal to the surface by use of a tool such as an overshot to engage the J-slots on the housing head of the lower body section.

What is claimed is:

1. Apparatus for releasably coupling an upper tubing string with a lower tubing string in a well bore comprising; a lower tubular body section connectible on the upper end of a lower tubing string; an upper tubular body section connectible on the lower end of an upper tubing string; said lower and upper body sections being disconnectible and connectible together by longitudinal movement only of one of said sections relative to the other of said sections; and locking means on said upper and on said lower body sections each operable by hydraulic pressure for disconnecting said upper section from said lower section and for reconnecting said upper section with said lower section.

2. Apparatus in accordance with claim 1 wherein said locking means is released by casing pressure and thereafter held locked by tubing pressure.

3. Apparatus in accordance with claim 2 wherein said locking means comprises an annular locking collet on one of said body sections and an annular collet lock and an interconnected hydraulic operator piston on the other of said body sections.

4. Apparatus in accordance with claim 1 wherein said locking means is released by casing pressure including spring means for biasing said locking means to a locked condition.

5. Appartus in accordance with claim 4 wherein said locking means is an annular locking collet on one of said body sections and an annular collet lock and interconnected hydraulic operator piston on the other of said body sections and said spring biases said collet lock and hydraulic operator piston toward said locking condition.

6. Apparatus in accordance with claim 1 wherein said locking means is released by tubing pressure and said locking means is thereafter held locked by casing pressure.

7. Apparatus in accordance with claim 6 wherein said locking means is an annular locking collet on one of said body sections and an annular collet lock and interconnected hydraulic operator piston on the other of said body sections.

8. Apparatus in accordance with claim 1 wherein said locking means is released by tubing pressure and includes spring means biasing said locking means toward a locked condition.

9. Apparatus in accordance with claim 8 wherein said locking means is an annular locking collet on one of said body sections and an annular collet lock and interconnected hydraulic operator piston on the other of said body sections and said spring means is connected with said collet lock and hydrauic operator piston.

10. A tubing seal divider for releasably coupling an upper tubing string with a lower tubing string in a well bore comprising: a lower tubular body section connectible at a lower end on the upper end of a lower tubing string in a well bore including an annular hydraulic cylinder and an annular locking recess spaced from said hydraulic cylinder, and an annular lock having a locking sleeve movable around said locking recess and an integral annular hydraulic piston movable in said hydraulic cylinder and hydraulic fluid passage means leading to said hydraulic piston for communicating casing annulus pressure on the other side of said piston; and an upper body section connectible on the lower end of an upper tubing string and telescopically connectible into said lower body section including an annular locking collet having internal locking bosses insertable into said locking recess of said lower body section, said locking collet being adapted to telescope into said lower body section between said locking recess and said locking sleeve of said annular lock whereby said locking sleeve holds said locking collet in locked condition at one end position and releases said locking collet for removal of said upper body section from said lower body section at an opposite end position of said annular lock said piston being movable hydraulically between end positions for disconnecting and reconnecting said upper tubing string and said lower tubing string.

11. A tubing seal divider for releasably coupling an upper tubing string with a lower tubing string in a well bore comprising: a lower tubular body section connectible at a lower end on the upper end of a lower tubing string in a well bore including an annular hydraulic cylinder and an annular locking recess spaced from said hydraulic cylinder, and an annular lock including locking means movable over said locking recess and an integral annular hydraulic piston movable in said hydraulic cylinder between release and lock positions for disconnecting and reconnecting said upper and said lower tubing strings and hydraulic fluid passage means leading to said piston for communicating casing annulus pressure on one side of said piston and tubing pressure on the other side of said piston; and an upper body section connectible on the lower end of an upper tubing string and telescopically connectible into said lower body section to provide a fluid conducting coupling between said upper and lower tubing strings including an annular locking collet having locking bosses engageable in said annular locking recess of said lower body section for releasably holding said upper body section with said lower body section, said locking collet telescoping into said lower body section between said locking recess and said annular lock whereby said annular lock holds said locking collet in locked condition at one end position and releases said locking collet for removal of said upper body section from said lower body section at an opposite end position of said annular lock.

12. A tubing seal divider in accordance with claim 11 wherein said annular lock includes a locking sleeve slidable over said locking collet.

13. A tubing seal divider in accordance with claim 12 wherein said annular lock is releasable by casing annulus pressure.

14. A tubing seal divider in accordance with claim 13 including a spring connected with said hydraulic piston for biasing said annular lock toward a locking position.

15. A tubing seal divider in accordance with claim 10 wherein said annular lock includes collet fingers having locking heads alignable with said locking collet to hold said locking collet locked and movable longitudinally to a release position responsive to tubing pressure.

16. A tubing seal divider in accordance with claim 15 including a spring coupled with said annular lock for biasing said lock toward a locking position.

17. A tubing seal divider for releasably coupling an upper tubing string with a lower tubing string in a well bore comprising: a lower tubular housing section connectible at a lower end on the upper end of a lower tubing string including an outer housing sleeve, an inner tubular mandrel concentrically spaced within said housing sleeve defining therebetween a hydraulic fluid pressure chamber, port means in said inner mandrel communicating the bore through said mandrel with said pressure chamber, an external annular locking recess on said inner mandrel spaced from said pressure chamber, an annular piston slidable in said pressure chamber, annular lock means on said piston movable with said piston between a first locking position around said locking rec ess of said inner mandrel and a second release position misaligned from said annular locking recess, and an upper body section connectible at an upper end with the lower end of an upper tubing string and having a tubular housing portion sized to telescope over said inner mandrel of said lower housing section, internal annular seal means in said upper body section tubular housing for sealing between said tubular housing and said inner mandrel of said lower housing section, and an annular locking collet on the lower end of said housing of said upper body section for telescoping into said lower body section between said housing of said lower body section and said inner mandrel of said lower body section, said locking collet having internal locking bosses engageable in said locking recess of said inner mandrel of said lower body section, said locking collet being held in locking engagement with said locking recess when said annular lock of said lower body section is at said first position and being releasable from said locking recess when said annular lock is at said second position said piston being hydraulically movable between said first and second positions for disconnecting and reconnecting said upper and said lower tubing strings.

18. A tubing seal divider in accordance with claim 17 wherein said locking means on said annular piston comprises a locking sleeve and said piston is movable to said second release position by casing annulus pressure.

19. A tubing seal divider in accordance with claim 18 including a spring in said pressure chamber connected with said piston for biasing said piston toward said first locked position.

20. A tubing seal divider in accordance with claim 17 wherein said locking means on said annular piston comprises a plurality of circumferentially spaced locking collet fingers having locking heads alignable at locking positions along said locking collet of said upper housing section at said first position and misaligned along said locking collet for release of said collet at a second position, and said housing of said lower body section includes an internal annular release recess to permit expansion of said locking collet fingers on said piston at said release position to permit release of said locking collet on said upper housing section.

21. A tubing seal divider in accordance with claim 20 wherein said annular piston is operable for movement of said annular lock to said first release position by tubing pressure.

22. A tubing seal divider in accordance with claim 21 including a spring in said pressure chamber connected with said annular piston for biasing said annular lock toward said first locking position.

* * * * *